United States Patent [19]

Dvorak et al.

[11] Patent Number: 4,809,987

[45] Date of Patent: Mar. 7, 1989

[54] BOARD GAME APPARATUS REPRESENTING DESTINATIONS

[76] Inventors: Robert E. Dvorak, 7021 Date Palm Ave. S., St. Petersburg, Fla. 33707; Frank D. Fattedad, 302 - 5411 Arcadia Road, Richmond, B.C., Canada, V6X 2H1

[21] Appl. No.: 72,397

[22] Filed: Jul. 13, 1987

Related U.S. Application Data

[63] Continuation of Ser. No. 712,359, Mar. 15, 1985, Pat. No. 4,679,798.

[51] Int. Cl.[4] ..... A63F 3/00

[52] U.S. Cl. ..... 273/254; 273/290

[58] Field of Search ..... 273/254, 251, 252, 248, 273/249, 243, 256, 290, 289, 288, 258

[56] References Cited

U.S. PATENT DOCUMENTS

| | | | |
|---|---|---|---|
| 1,065,775 | 6/1913 | Brewer | 273/248 |
| 2,268,433 | 12/1941 | Smith | 273/248 |
| 3,414,264 | 12/1968 | Schriber | 273/249 |
| 3,582,080 | 6/1971 | Schick | 273/243 |
| 3,656,757 | 4/1972 | Carroll | 273/252 |
| 3,726,527 | 4/1973 | Schauffler | 273/256 |
| 3,751,039 | 8/1973 | Dykoski | 273/290 X |
| 3,799,551 | 3/1974 | Erickson | 273/252 |
| 4,049,276 | 9/1977 | Hole | 273/252 |
| 4,071,245 | 1/1978 | Kendrick | 273/248 |
| 4,078,803 | 3/1978 | Te | 273/248 |
| 4,109,917 | 8/1978 | Hatcher | 273/254 |
| 4,211,419 | 7/1980 | Larsen | 273/248 |
| 4,262,907 | 4/1981 | Ginsberg et al. | 273/249 |
| 4,283,059 | 8/1981 | Beeder | 273/256 X |
| 4,377,287 | 3/1983 | Erwin | 273/252 |
| 4,385,765 | 5/1983 | Mun et al. | 273/253 |
| 4,411,432 | 10/1983 | Stevens | 273/251 |
| 4,426,084 | 1/1984 | Michel | 273/254 |

FOREIGN PATENT DOCUMENTS

| | | | |
|---|---|---|---|
| 925533 | 5/1973 | Canada | 273/254 |
| 645661 | 11/1950 | United Kingdom | 273/251 |

*Primary Examiner*—Richard C. Pinkham
*Assistant Examiner*—Benjamin Layno
*Attorney, Agent, or Firm*—Christensen, O'Connor, Johnson & Kindness

[57] ABSTRACT

A game board apparatus with a game board and two types of playing pieces. The game board is provided with a playing surface which displays a plurality of interconnected first symbols that may represent specific geographic locations interconnected by transportation routes. At some or all of the first symbols are reversibly positioned second playing pieces that may represent passengers or cargo. Each second playing piece is marked in a manner to indicate a specific first symbol that is its destination. Each of two or more players employs and moves at least one first playing piece, which may resemble an airplane or other vehicle, to carry a finite number of the second playing pieces to their specified destinations. Each player must determine which transportation routes to take and what combination and quantity of second playing pieces to load, so that he or she will maximize the utility of the limited second playing piece carrying capacity of the first playing piece by coordinating the current load with future loads. The game is over when all of the second playing pieces have been delivered to their specified destinations. The winner is the player who transported the greatest quantity or value of second playing pieces to their specified destinations.

13 Claims, 5 Drawing Sheets

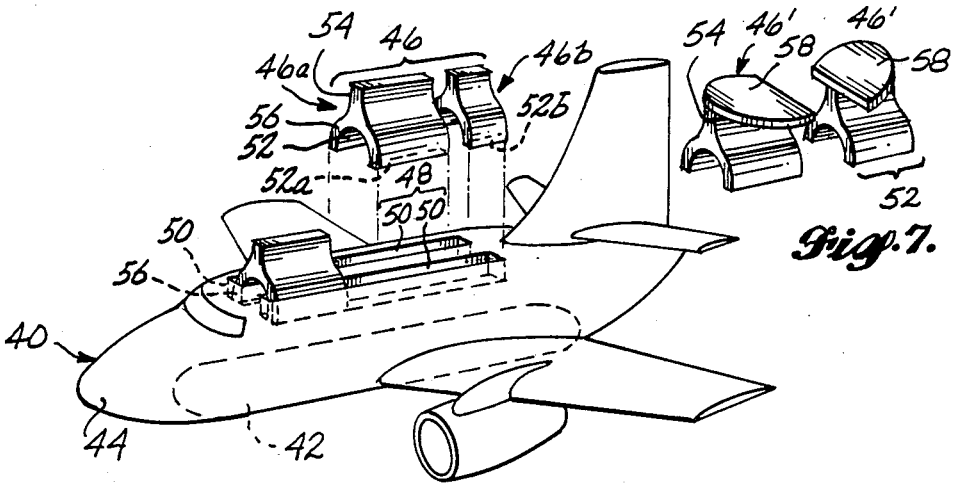
Fig. 6.
Fig. 7.
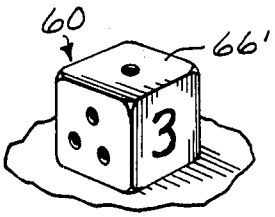
Fig. 8.
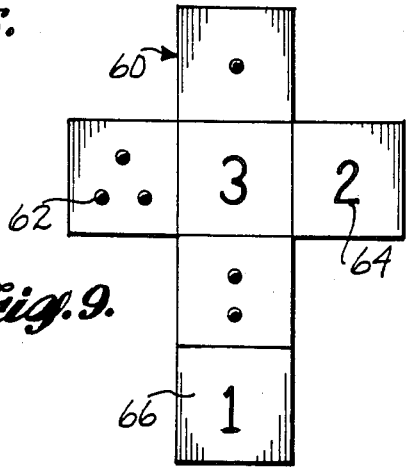
Fig. 9.
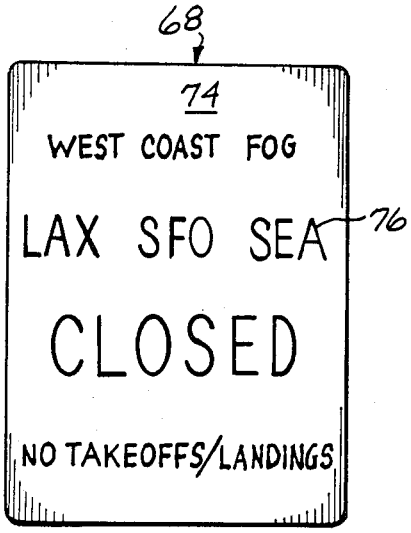
Fig. 10.
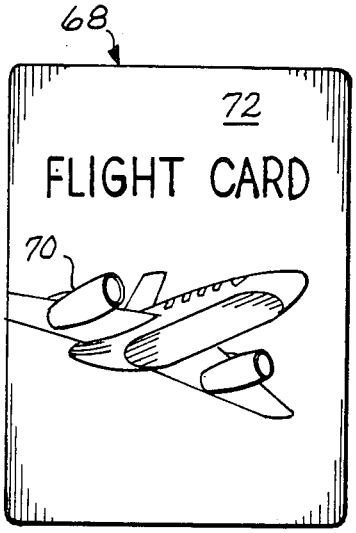
Fig. 11.

BOARD GAME APPARATUS REPRESENTING DESTINATIONS

This is a continuation of the prior application Ser. No. 712,359, filed Mar. 15, 1985, now U.S. Pat. No. 4,679,798, the benefit of the filing dates of which are hereby claimed under 35 USC 120.

FIELD OF THE INVENTION

This invention relates to board game apparatuses wherein pieces are moved over a board having a pattern and, in the preferred embodiment, to transportation games.

BACKGROUND OF THE INVENTION

Games employing movement of playing pieces over a patterned game board are popular, and game boards with rectangular, circular, and abstract patterns have been developed for playing such games. Transportation games are known, and games apparatuses employing air transport, rail transport, trucking, subway, space travel, and shipping themes have been developed. However, game apparatuses have not been provided for games that require the player to select his or her route and cargo load so as to optimally utilize, for both current and future moves, a limited amount of playing piece cargo carrying capacity.

SUMMARY OF THE INVENTION

The present invention provides a game board apparatus for playing a strategic and entertaining game. A game board and two types of playing pieces are provided. That game board is provided with a playing surface which displays a plurality of first symbols that may represent destinations. Each of the first symbols has a plurality of different coded first indicia displayed thereon such that each of the first symbols is distinguishable. The game is also provided with a plurality of second symbols representing destinations, with the second symbols not displaying any of the first indicia. The first playing pieces also do not display any of the first indicia, such playing pieces having portions specifically configured for selectively receiving and carrying at least one second playing piece. Second playing pieces of different sizes are adapted to be received and carried by the first playing pieces. Each of the second playing pieces displays at least a portion of one of the first indicia displayed on the first symbols.

In a specific form of the present invention, the first playing pieces are configured to correspond with the nature of the destinations represented by the first and second symbols. The first playing pieces are used to carry the second playing pieces among the different destinations represented by the first and second symbols.

BRIEF DESCRIPTION OF THE DRAWINGS

FIG. 6 is a partial sectional view of a first playing piece and also showing three second playing pieces, one of which is reversibly inserted into the first playing piece;

FIG. 7 is a side view of a pair of second playing pieces, each of which is provided with an apical token that corresponds to half of a first indicium such as shown in FIG. 3;

FIG. 8 is an isometric view of a special die;

FIG. 9 is a combination view showing the six faces of the special die;

FIG. 10 is a plan view of the primary surface of a playing card; and

FIG. 11 is a plan view of the secondary surface of a playing card.

DESCRIPTION OF THE PREFERRED EMBODIMENT

Figure 1:
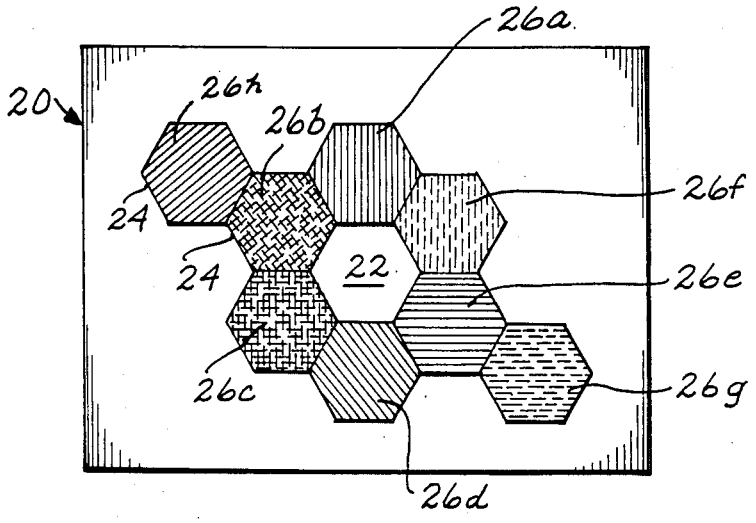
FIG. 1 is a plan view of a game board upon which first symbols are directly interconnected.

Referring to FIG. 1, a game board 20 is provided with a playing surface 22 upon which interconnected first symbols 24 are printed or otherwise displayed. A plurality of first symbols 24 are positioned in nonoverlapping arrangement over the playing surface 22. The first symbols 24 can be directly interconnected, as in this embodiment wherein each first symbol 24 is positioned so as to contiguously border at least one other first symbol 24. The first symbols 24 are distinguished one from another by first indicia 26, such as by color codes. For example, each of eight first symbols 24 can be uniquely pigmented red 26*a*, orange 26*b*, yellow 26*c*, green 26*d*, blue 26*e*, violet 26*f*, gray 26*g*, or brown 26*h*.

Figure 2:
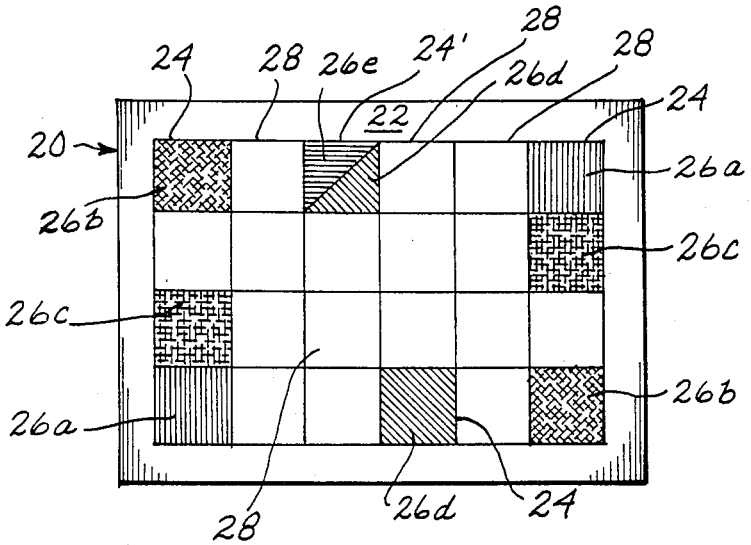
FIG. 2 is a plan view of a game board as in FIG. 1 except that many of the first symbols are indirectly interconnected by second symbols.

Referring now to FIG. 2, some or all of the first symbols 24 can be indirectly interconnected through second symbols 28. In this particular embodiment each first symbol 24 is positioned so as to contiguously border a plurality of other symbols, at least one of which is a second symbol 28. The first and second symbols 24, 28 are distinguished one type from the other by the absence of first indicia 26 on the second symbols 28. For example, here the various first symbols 24 are distinctly (but in this case not uniquely) color coded 26*a–e*, but the various second symbols 28 all lack corresponding pigmentation and are thereby collectively distinguished from the first symbols 4. One or more of the first symbols 24 can display a plurality of the first indicia 26. For example, a particular first symbol 24' can display both a green first indicium 26d and a blue first indicium 26*e*.

Figure 3:
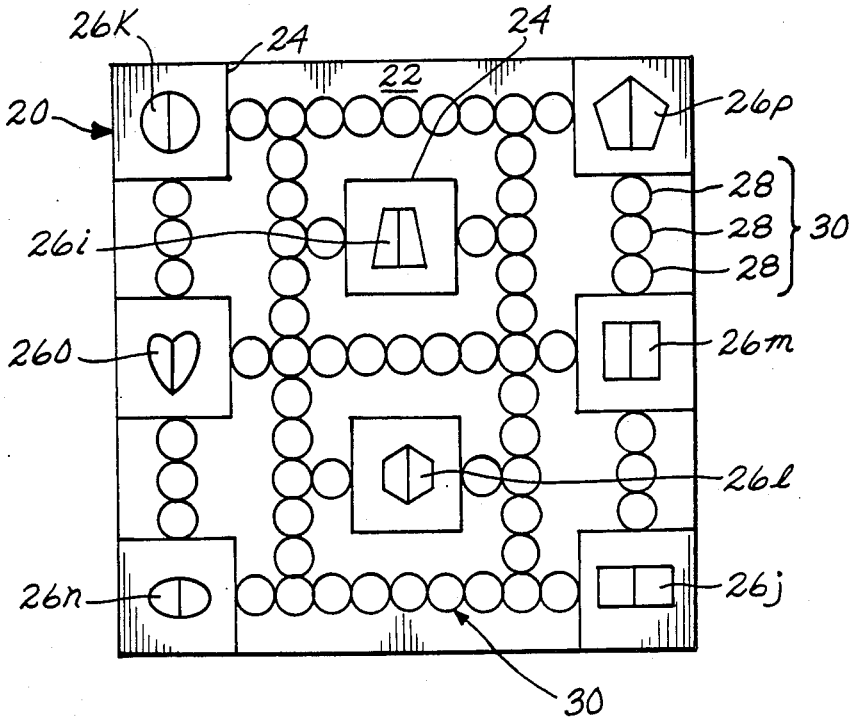
FIG. 3 is a game board as in FIG. 2 except that the second symbols are contiguously arranged in linear arrays that indirectly interconnect the first symbols.

Referring now to FIG. 3, the first and second symbols 24, 28 can be positioned in spaced arrangement over the playing surface 22 so that all of the first symbols 24 are indirectly interconnected by second symbols 28 and also so that the second symbols 28 are contiguously arranged in linear arrays 30 that extend between and connect various of the first symbols 24. In this particular embodiment the linear arrays 30 branch, cross, and anastomose as they interconnect the first symbols 24 in various ways. These particular second symbols 28 are distinguishable from the first symbols 24 by lacking first indicia 26, in this case symbolic coding 26*i–p* such as the heart-shaped symbol 26*o*, that individually distinguishes the various first symbols 24. These particular second symbols 28 are also distinguishable from the first symbols 24 by second indicia 32, in this case by differences in shape and size, the circular second symbols 28 having distinctly smaller dimensions and areas than the square first symbols 24.

Figure 4:
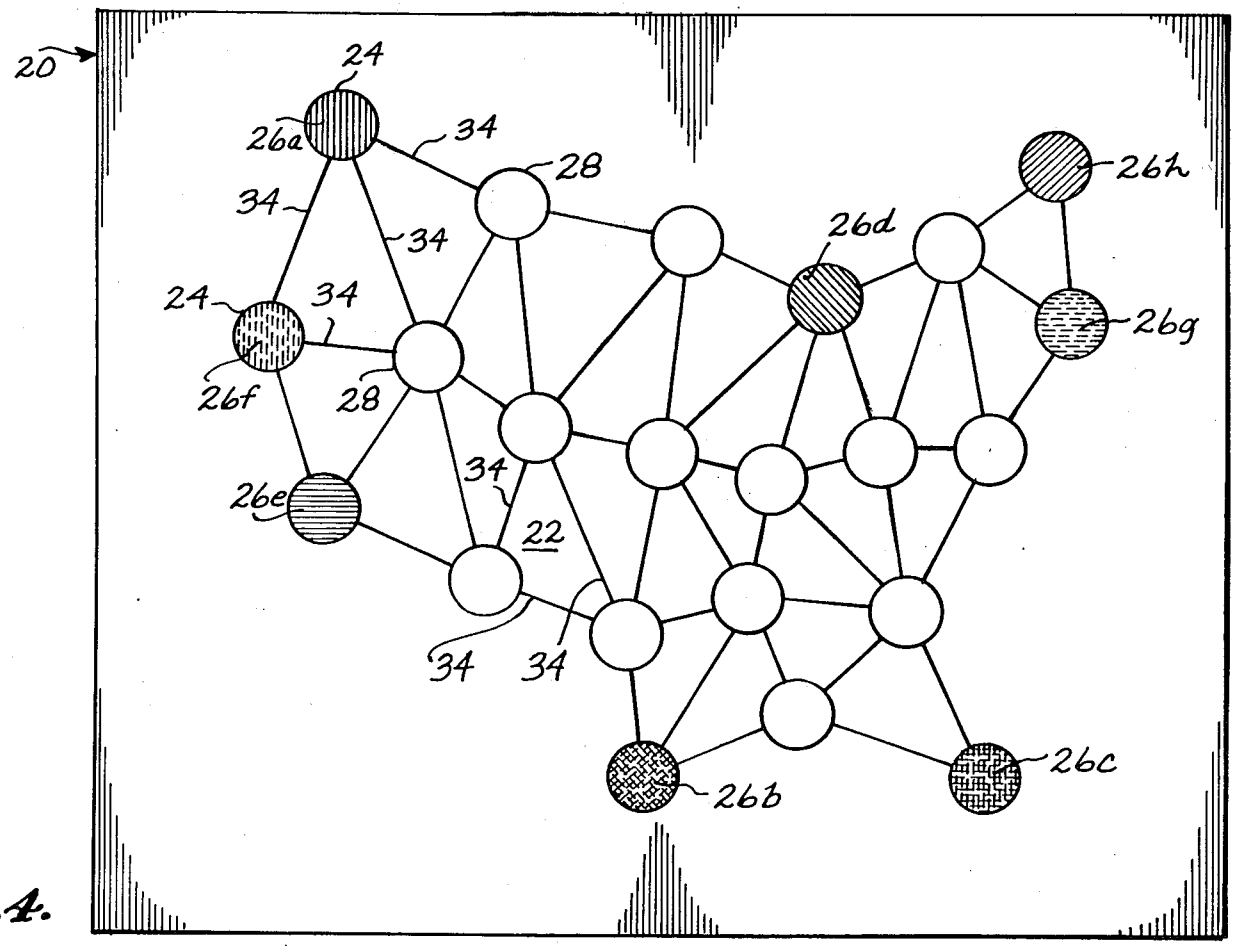
FIG. 4 is a game board as in FIG. 3 except that the first and second symbols are interconnected by third symbols.

Referring now to FIG. 4, in a related embodiment both first and second symbols 24, 28 can be spaced in noncontiguous arrangement over the playing surface 22, in which case a plurality of third symbols 34 can be located and displayed on the playing surface 22 so as to extend between and connect various of the first and second symbols 24, 28. The third symbols 34 can, for example, be lines, as shown in this view, or unidirectional arrows. In this particular embodiment the third symbols 34 neither branch nor cross one another as they interconnect the first and second symbols 24, 28 in various ways. In a preferred embodiment each of about two dozen first and second symbols 24, 28 is indirectly connected through third symbols 34 to between two and six adjacent first or second symbols 24, 28, with each of about eight first symbols 24 being connected to between two and five adjacent first or second symbols 24, 28, no more than one or two of which are other first symbols 24, and with any first symbols 24 being removed from any other first symbols 24 by no more than seven and eight intervening second symbols 28 and third symbols 34, respectively.

Figure 5:
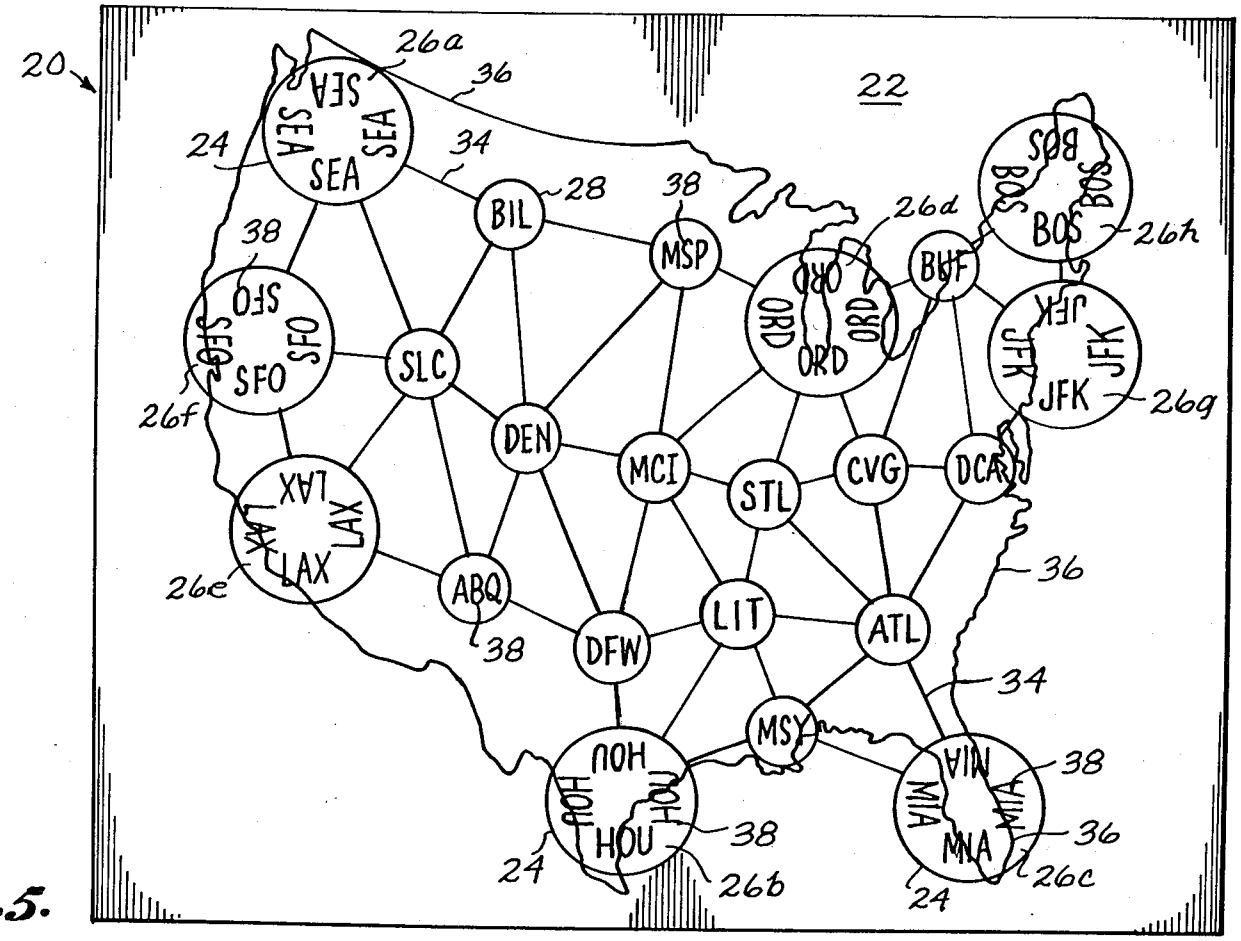
FIG. 5 is a plan view of a game board as in FIG. 4 for playing an air transportation game.

Referring now to FIG. 5, the game board 20 can be used to play a transportation game, in which case any or all of the aforementioned symbols 24, 28, 34 can be superimposed over an outline map 36 of a geographical region or country. Second and/or first symbols 28, 24 can be positioned in spaced arrangement thereon to represent geographical locations such as population centers, cities, or airports, and third symbols 34 (or arrays 30 of second symbols 28) can be positioned so as to represent transportation routes that extend between and connect various of the geographical locations. In this particular embodiment the playing surface 22 is provided with an outline map 36 of the forty-eight contiguous states of the United States of America, and both first symbols 24 and second symbols 28 are superimposed in noncontiguous arrangement thereon to represent what are designated as destination and transit airports, respectively, for the purposes of the game play. Third symbols 34 are provided that variously interconnect the first and second symbols 24, 28 and that thereby represent air travel routes that connect the designated destination and transit airports in various ways. The first symbols 24 which represent destination airports are individually distinguished by color-coded first indicia 26, which in this view are indicated by reference numerals 26*a–h*. The first and second symbols 24, 28 are distinguished one type from another by the presence or absence, respectively, of the aforementioned first indicia 26 and also by second indicia 32: in this embodiment by a size differential, the first symbols 24 being distinctly larger than the second symbols 28. In this embodiment the various first and second symbols 24, 28 are also individually distinguished by third indicia 38 in the form of three-letter acronyms that correspond to standard commercial aviation industry symbols for cities or airports; for example, HOU for Houston, LAX for Los Angeles International Airport.

In other preferred embodiments the game board is configured as stated in the preceding paragraph except that an outline map 36 of either Canada or the World is provided, and the third indicia 38 are correspondingly modified to indicate population centers, cities, or airports within those geographical regions.

Referring now to FIG. 6, a plurality of distinguishable first playing pieces 40 are also provided. Each first playing piece 40 has a lower surface 42 that is adapted for manual placement on the playing surface 22 at selected second symbols 28 and/or first symbols 24 and for travel over the playing surface 22 between first symbols 24, e.g., on third symbols 34 or arrays 30 of second symbols 28. Each first playing piece 40 has an upper surface 44 that is adapted for selectively receiving and carrying one or more of the second playing pieces 46 that are described below. The first playing pieces 40 can be configured to represent transportation vehicles such as planes, ships, and trucks, and can be made individually distinguishable by, e.g., pigmenting them with hues that preferably do not correspond with any first indicia 26.

In this particular embodiment the first playing pieces 40 are configured to simulate the form and appearance of airplanes. The lower surface 42 of each first playing piece 40 is flat. The upper surface 44 of each first playing piece 40 contains a cavity 48 in the form of two slots 50, each slot 50 having the shape of a right prism with rectangular bases, that are disposed in spaced parallel array one on either side of the longitudinal axis of the first playing piece 40.

A plurality of second playing pieces 46 of one or more sizes are also provided. Each second playing piece 46 is configured such that it can be received and carried by any of the first playing pieces 40. In a preferred embodiment, each second playing piece has a base 52 that is configured so as to be reversibly received and carried by any of the first playing pieces 40 and an apex 54 that is developed into a manipulable handle.

In the particular embodiment shown in FIG. 6, each second playing piece 46 has a generally Y-shaped configuration so that the arms and stem of the Y define the base 52 and apex 54, respectively. The base 52 of each of these second playing pieces 46 has a pair of parallel legs 56 that permit upright placement of the second playing piece 46 on the playing surface 22 of the game board 20. The dimensions and dispositions of the legs 56 also correspond generally to those of the slots 50 in any of the first playing pieces 40 and, thus, the second playing piece legs 56 can be reversibly inserted into those slots 50. The length of each slot 50 preferably exceeds the length of a second playing piece base 52 by a fixed multiple, as described below. In this particular embodiment two sizes of second playing pieces 46 are provided: large second playing pieces 46*a* and small second playing pieces 46*b*, with the large second playing pieces 46*a* having bases 52*a* that are twice as long as the bases 52*b* of the small second playing pieces 46*b*.

Referring still to FIG. 6, the cavity 48 in the upper surface 44 of each first playing piece 40 is correspondingly configured to reversibly receive and carry the base 52 of any of the second playing pieces 46. In a preferred embodiment the length of each cavity 48 corresponds to or slightly exceeds five times the length of the base 52*b* of a small second playing piece 46*b* (or two and one-half times the length of the base 52*a* of a large second playing piece 46a). The cavity 48 thus configured can receive and carry the above-described second playing pieces 46 in the following finite combinations: either a maximum carrying capacity load consisting of two large 46*a* and one small 46*b*, one large 46*a* and three small 46*b*, or five small 46*b*; or partial loads consisting of two large 46*a*, one large 46*a* and two small 46*b*, four small 46*b*, one large 46*a* and one small 46*b*, three small 46b, one large 46a, two small 46b, or one small 46b; or none (empty).

A minimal number of second playing pieces 46 should be provided such that there are the equivalent of two full carrying capacity loads for each first playing piece 40 employed in the game. Using standard mathematical notation, this minimum number (m) of second playing pieces 46 can be stated as follows:

$$\sum_{i=1}^{n} \frac{m_i}{(Y)(Z_i)} \geqq 2$$

wherein n is a positive integer that denotes the number of sizes of second playing pieces 46 that are provided, Y is the number of first playing pieces 40, and Z is the second playing piece carrying capacity of each first playing piece 40. Furthermore, each first indicium 26 should be displayed at least once on one or more of the second playing pieces 46 that are provided.

In the preferred embodiment the number of second playing pieces 46 that are provided is related to the number (X) of first symbols 24, the number of provided second playing pieces 46 being X(X−1)n, or multiples thereof, wherein n is a positive integer, preferably either one or two, that denotes the number of sizes of second playing pieces 46 that are provided. In other words, if the second playing pieces 46 are provided in two sizes 46a, 46b, then X(X−1) large second playing pieces 46a and X(X−1) small second playing pieces 46b are provided, with X being a positive integer that denotes the number of first symbols 24 on the playing surface 22 of the game board 20. Furthermore, of the X(X−1) second playing pieces 46 of each size class, (X−1) of those should correspondingly display a first indicium 26, such as a particular color code, that distinguishes each of the first symbols 24.

The aforementioned minimal number of second playing pieces 46 is selected such that the game play as described below will encompass at least two rounds of turns, that is, so that each player will have an opportunity to coordinate at least two cargo loads per game. The preferred number of second playing pieces 46 is selected in order to maximize the strategic choices in the game play and facilitate set up as described below.

Referring now to FIG. 7, in another embodiment second playing pieces 46' are provided with an apex 54 that is developed into a token 58 that corresponds with all or part of a first indicium 26. For example, the second playing pieces 46' shown in this view are capped by tokens 58 with hemiheartshaped configurations. A correspondingly coded first symbol 24, such as shown in FIG. 3, can display a first indicium 26o in the shape of a heart, in which case each token 58 corresponds with a portion, i.e., one-half, of a first indicium 26. Other second playing pieces 46' can similarly be provided with tokens 58 configured as other geometric forms that correspond to symbolically coded first indicia 26, such as the first indicia 26i–p shown in FIG. 3, or portions thereof.

Referring now to FIGS. 8 and 9, a movement specifier 60 can be optionally provided. Various fifth and/or fourth indica 64, 62 are displayed on the movement specifier 60, and means are provided for randomly selecting any one of the fourth or fifth indicia 62, 64. The fourth indicia 62 denote various first playing piece movement designations. For example, the movement specifier 60 can be a standard die (not shown), in which case the fourth indicia 62 can correspond to the symbolic numeral code on the faces of the die. Fifth indicia 64, where optionally utilized, denote various first playing piece movement designations in combination with a playing card designation. In the particular embodiment shown in these views, a movement specifier 60 in the form of a special die is provided with three faces 66 having symbolic numeral fourth indicia 62 in the form of dots and with three faces 66 having Arabic numeral fifth indicia 64. The special die 60 is tossed to randomly select a fourth or fifth indicium 62, 64 on the uppermost face 66' when the die 60 comes to rest. Alternatively, a movement specifier 60 in the form of a dial spinner having either fourth indicia 62 or fourth and fifth indicia 62, 64 as described above may be provided.

Referring now to FIGS. 10 and 11, special playing cards 68 can also be optionally provided. The playing cards 68 display a uniform ornamental pattern 70 on their secondary surfaces 72. On their primary surfaces 74 the playing cards 68 display one of various sixth indicia 76 that designate particular conditions of penalty or bonus to which a first playing piece movement designation as denoted by a fifth indicium 64 on the movement specifier 60 is subject. Some representative sixth indicia 76 for use in an air transportation game embodiment are presented here: 1. East coast fog, BOS, JFK and DCA CLOSED, no takeoffs or landings; 2. Midwest blizzard, ORD, MSP, MCI and STL CLOSED, no takeoffs or landings; 3. Northern snow storm, BOS, BUF, ORD, MSP and BIL CLOSED, no takeoffs or landings; 4. West coast fog, LAX, SFO and SEA CLOSED, no takeoffs or landings; 5. Hurricane, MIA, MSY and HOU CLOSED, no takeoffs or landings; 6. Waited for connecting passengers, MINUS ONE FROM DIE COUNT; 7. Waited for late crewmembers, MINUS ONE FROM DIE COUNT; 8. runway congestion, MINUS ONE FROM DIE COUNT; 9. Baggage loading delay, MINUS ONE FROM DIE COUNT; 10. Face strong headwind, MINUS ONE FROM DIE COUNT; 11. Favorable tailwind, PLUS ONE TO DIE COUNT; 12. Strong tail wind, PLUS TWO TO DIE COUNT; 13. Jumped takeoff queue, PLUS ONE TO DIE COUNT; 14. Clear weather ahead, HAVE A GOOD FLIGHT; and 15. Takeoff aborted, FORFEIT MOVE. If the first and second symbols 24, 28 are not provided with third indicia 38, or if second symbols 28 are not provided on the game board 20, then first indicia 26 representing various of the first symbols 24 can be substituted for the acronyms 38 in the above-listed representative sixth indicia 76.

With the game apparatus provided in combination as described above, and preferably in combination as described with reference to FIGS. 5, 6, 8, 9, 10, and 11 above, the novel game is ready for play. The object of the game is to carry the greatest number of second playing pieces 46 to the correspondingly coded first symbols 24 and thereby accrue the most total points.

A simple embodiment of this game is played with second playing pieces 46 of one size, such as with the small second playing pieces 46a described above that fit in finite combination of up to five per first playing piece cavity 48. The game apparatus is set up by selectively distributing the second playing pieces 46 on the playing surface 22 of the game board 20 such that each particular first symbol 24 has (X−1) second playing pieces 46 positioned thereon, including one second playing piece 46 that displays each of the various first indicia 26 except for the corresponding first indicium (or plurality of first indicia) 26 displayed on the particular first symbol 24. For example, if the first indicia 26 comprise a color code, then a red first symbol 24 should be set up with one second playing piece 46 of every color except red, a blue first symbol 24 should be set up with one second playing piece 46 of every color including red but excluding blue, and so one. The playing cards 68 are shuffled into a deck and placed, primary surfaces 74 down, at a location convenient to the players.

Two or more players then determine who will start the play. The starter selects a first symbol 24 and a first playing piece 40 and positions the selected first playing piece 40 on the playing surface 22 at the selected first symbol 24. Following a predetermined order, other players select from among the remaining, unoccupied first symbols 24 and the remaining first playing pieces 40 and position their selected first playing pieces 40 on their selected first symbols 24. The starter then begins the lay by loading his or her first playing piece, moving, and unloading, all as described below. Play continues in the predetermined order.

A player can load any combination of second playing pieces 46 up to a maximum of, e.g., five small second playing pieces **46*a* into the cavity 48 of his or her first playing piece 40. The second playing pieces 46 that make up the load can be selected with any combination of first indicia 26 from among the various second playing pieces 46 that are available at the particular first symbol 24 at which loading occurs. There is no minimum load, and a first playing piece 40 may be moved empty. However, if loading is desired, the first playing piece 40 must be loaded before rolling the die 60. Once the die 60 is thrown, the player must move the first playing piece 40 without further loading, even if the first playing piece 40** is empty.

After loading his or her first playing piece 40 the player rolls the die 60. Dotted faces 62 on the die 60 indicate that it is clear to move the first playing piece 40 along the third symbols 34 for a distance equal to the number of first or second symbols 24, 28 indicated by the number of dots 62 on the uppermost face 66' of the rolled die 60. Numbered faces 64 on the die 60 require the player to draw the top playing card 68 from the deck. A player drawing a playing card 68 must comply with its instructions as indicated by the sixth indicia 76 thereon. In either event the die count rolled 62, 64 (including any bonus or penalty dictated by a playing card 68), is the number of moves the player must make. Moves can only be made between first and/or second symbols 24, 28 along connecting third symbols 34. Each first or second symbol 24, 28 visited counts as one move. A first or second symbol 24, 28, including that from which the player starts the turn, may not be visited twice during one turn. A first or second symbol 24, 28 occupied by another first playing piece 40 may not be visited. If a player cannot move the die count rolled, due to blocking by other first playing pieces 40, then the player must forfeit that move. A first playing piece 40 must arrive at a destination first symbol 24 by exact count.

Unloading of second playing pieces 46 is permitted only after the player has moved his or her first playing piece 40 and before the next player begins his or her turn. Complete, partial, or even no unloading is allowed. Second playing pieces 46 that are unloaded at a first symbol 24 with a corresponding first indicium 26, for example a red second playing piece 46 unloaded at a red first symbol 24, becomes winnings that are removed from the board 20 and kept by the unloading player for totaling at the end of the game.

The game is over when all second playing pieces 46 have been delivered to correspondingly coded first symbols 24 and removed as winnings from the board 20. Each player then totals his or her winnings. The player possessing the greatest number of winnings is declared the winner. If a tie occurs the player whose first playing piece 40 ended the game at a higher ranked first or second symbol 24, 28 prevails. For example, the first or second symbols 24, 28 can be ranked according to the alphabetical order of the acronyms 38 displayed thereon, e.g., ABQ, ATL, BIL, and so on.

In a simpler preferred embodiment suitable for younger players the game is played as described above but using first playing pieces 40 each having a maximum carrying capacity of one second playing piece 46.

In a more strategic preferred embodiment suitable for older players the game is played as described above but using second playing pieces 46 of two sizes, such as the small and large second playing pieces **46*a*, 46*b*. One large and one small second playing piece 46*a*, 46*b* displaying each noncorresponding first indicium 26 are positioned at each first symbol 24 to set up the game. The player thus has many strategic choices to make in selecting his or her route and cargo load so as to optimally utilize the limited carrying capacity of the first playing piece 40** for both current and prospective moves.

The small second playing pieces **46*b* can be valued at fifty points apiece, and the large second playing pieces 46*a* can count as one hundred points apiece, for the purposes of totaling winnings. For example, each small second playing piece 46*b* can represent fifty passengers, and each large second playing piece 46*a*** can represent one hundred passengers in which case the player who transports the most passengers by the end of the game is declared the winner.

Special game rules can also be added in order to increase the strategic nature of the game play. For example, a player leaving no second playing pieces 46 behind when moving from a first symbol 24 may be entitled to a non-stop flight directly to any other, unoccupied first symbol 24 of choice. The player must however declare the intention to fly non-stop instead of rolling the die 60. Once the player throws the die 60 the non-stop flight privilege is forfeited, and the move must be made according to the die count rolled 62, 64 (including any applicable playing card modifications).

A simpler but even more strategic game can be played by fixing the distance of each playing move at a certain number of first or second symbols 24, 28, e.g., three, in which case the game apparatus can be provided and used without the movement specifier 60 or the playing cards 68, for example as described with reference to FIGS. 5 and 6 alone, and preferably as described with reference to FIG. 7 and/or 6 and either of FIGS. 1, 2, or 3.

In all cases the playing surface 22 can be provided with one or more first symbols 24 that each display a plurality of first indicia 26, such as unloading thereon of second playing pieces 46 displaying either one or all of the corresponding first indicia 26. As another example, the first symbols 24 can display symbolic first indicia 26 such as the first indicia **26*i–p* shown in FIG. 3, and the second playing pieces 46 can display tokens 58 such as those shown in FIG. 7** that correspond to only a portion, for example one-half, of any of the first indicia 26*i–p*. The game rules can then specify that winnings must result from a simultaneous unloading of pairs of second playing pieces 46 such that they correspond in combination to the first indicium 26 at the destination first symbol 24.

While the present invention has been described in conjunction with preferred embodiments, one of ordinary skill after reading the foregoing specification will be able to affect various changes, substitutions of equivalents, and other alterations to the game board apparatus and game play set forth herein. The enjoyable game play that is provided by this game board apparatus derives from the strategic choices that are provided by the multiplicity of possible interactions of the game apparatus components, and particularly by the strategic optimization of the direction of movement and the loading of the first playing pieces. Thus, the same game can be played by using the game apparatus in combination as described above but substituting for example a trucking, shipping, time management or abstract motif for the air transportation theme described in the preferred embodiment herein. It is therefore intended that the protection granted by letters patent hereon be limited only by the definition contained in the appended claims and equivalents thereof.

The embodiments of the invention in which an exclusive property or privilege is claimed are defined as follows:

1. A game apparatus comprising in combination:

(a) a game board displaying:

a plurality of first symbols representing destinations, each of said first symbols having a plurality of different coded first indicia displayed thereon such that each of the first symbols is distinguishable; and, a plurality of second symbols representing destinations, said second symbols not displaying any of the first indicia;

(b) a plurality of distinguishable first playing pieces that do not display any of the first indicia, each first playing piece having portions specifically configured for selectively receiving and carrying at least one second playing piece;

(c) a plurality of second playing pieces of at least one size, each second playing piece being adapted to be received and carried by any one of the first playing pieces, and with each second playing piece correspondingly displaying at least a portion of one of said first indicia displayed on said first symbols; and, (d) wherein said first playing piece having a configuration to correspond with the nature of the destinations represented by the first and second symbols for carrying said second playing pieces among the different destinations represented by the first and second symbols.

2. The game apparatus according to claim 1, wherein the second symbols represent intermediate destinations.

3. The game apparatus according to claim 1, wherein the first and second symbols represent airports.

4. The game apparatus according to claim 3, wherein the second symbols represent intermediate airports.

5. The game apparatus according to claim 1, further comprising third symbols that are located and displayed on the playing surface so as to extend between and connect various first and second symbols.

6. The game apparatus according to claim 5, wherein said third symbols represent transportation routes that extend between and connect the various first and second symbols.

7. The game apparatus according to claim 6, wherein the first and second symbols represent airports and third symbols represent air travel routes.

8. The game apparatus according to claim 7, wherein the first playing pieces are configured to represent aircraft.

9. The game apparatus according to claim 1, wherein the first and second symbols are also distinguishable one type from the other by second indicia.

10. The game apparatus according to claim 9, wherein the second indicia comprise different shapes or sizes.

11. The game apparatus according to claim 1, wherein the first and second symbols are individually distinguishable by coded third indicia displayed thereon.

12. The game apparatus according to claim 11, wherein the third indicia comprise words or acronyms..

13. The game apparatus according to claim 1, further comprising a movement specifier displaying a plurality of first playing piece movement designations thereon.

* * * * *

UNITED STATES PATENT AND TRADEMARK OFFICE

CERTIFICATE OF CORRECTION

PATENT NO. : 4,809,987

DATED : March 7, 1989

INVENTOR(S) : Robert E. Dvorak, et al.

It is certified that error appears in the above-identified patent and that said Letters Patent is hereby corrected as shown below:

Column 1, line 22 "games" should be --game--.

Column 1, line 40, after "game" insert --board--.

Column 2, line 49, "4." should be --24.--.

Column 5, line 50, "hemi heartshaped" should be --hemiheart-shaped--.

Column 6, line 34, "crewmembers," should be --crewmember,--.

Column 7, line 19, "lay" should be --play--.

Column 8, line 61, after "as" insert --shown in FIGURE 2. Then game rules can specify that winnings result from the--.

Signed and Sealed this

Thirtieth Day of January, 1990

*Attest:*

JEFFREY M. SAMUELS

*Attesting Officer*

*Acting Commissioner of Patents and Trademarks*